US007726525B2

(12) United States Patent
Nini

(10) Patent No.: US 7,726,525 B2
(45) Date of Patent: Jun. 1, 2010

(54) TAP FOR DISPENSING LIQUIDS FROM VESSELS

(75) Inventor: Diego Nini, Alessandria (IT)

(73) Assignee: Vitop Moulding S.R.L., Alessandria (IT)

( * ) Notice: Subject to any disclaimer, the term of this patent is extended or adjusted under 35 U.S.C. 154(b) by 484 days.

(21) Appl. No.: 11/577,352

(22) PCT Filed: Jun. 6, 2005

(86) PCT No.: PCT/IT2005/000317

§ 371 (c)(1),
(2), (4) Date: Apr. 16, 2007

(87) PCT Pub. No.: WO2006/046262

PCT Pub. Date: Apr. 5, 2006

(65) Prior Publication Data

US 2007/0290010 A1 Dec. 20, 2007

(30) Foreign Application Priority Data

Oct. 29, 2004 (IT) ..... TO 2004 A 0749

(51) Int. Cl.
*B67D 3/00* (2006.01)

(52) U.S. Cl. ..... 222/511; 222/518

(58) Field of Classification Search ..... 222/511–519, 222/521, 494, 406; 137/588, 589; 215/258; 220/569, 592.16, 592.17, 715
See application file for complete search history.

(56) References Cited

U.S. PATENT DOCUMENTS

| | | | | |
|---|---|---|---|---|
| 1,715,353 | A | 6/1929 | Cordley | |
| 3,731,851 | A * | 5/1973 | Rauh | 222/213 |
| 4,286,636 | A | 9/1981 | Credle | |
| 4,700,744 | A | 10/1987 | Rutter et al. | |
| 5,740,932 | A * | 4/1998 | Battegazzore | 215/252 |
| 6,131,767 | A * | 10/2000 | Savage et al. | 222/1 |
| 6,360,925 | B2 * | 3/2002 | Erb | 222/509 |
| 6,470,910 | B2 * | 10/2002 | Blackbourn et al. | 137/588 |
| 6,896,158 | B2 * | 5/2005 | Leray et al. | 222/145.1 |
| 2002/0079001 | A1 | 6/2002 | Blackbourn et al. | |
| 2002/0108973 | A1 | 8/2002 | Roethel et al. | |

* cited by examiner

*Primary Examiner*—Lien T Ngo
(74) *Attorney, Agent, or Firm*—David A. Farah; Sheldon Mak Rose & Anderson PC

(57) ABSTRACT

A tap (1) is disclosed for dispensing liquids from a vessel, composed of: a body (3) made in a single piece comprising: a supporting member (5) from which a liquid dispensing mouth (7) and air entering mouths (9) project; a resilient thrusting member (11) that allows/prevents the dispensing of liquids; and winged abutting means (12); and a valve member (14) contained inside the body (3) and adapted to engage at one end the outlet mouth of the vessel in order to open/close it, and adapted to further engage the resilient member (11) to open and close the liquid dispensing opening.

51 Claims, 11 Drawing Sheets

TAP FOR DISPENSING LIQUIDS FROM VESSELS

CROSS-REFERENCE TO RELATED APPLICATIONS

The present Application is a 371 of International Patent Application No. PCT/IT2005/000317, titled "Tap for Dispensing Liquids from Vessels" filed Jun. 6, 2005, which claims priority from Italian Patent Application No. TO2004A000749 filed Oct. 29, 2004, the contents of which are incorporated in this disclosure by reference in their entirety.

BACKGROUND INFORMATION

1) Field of the Invention

The present invention refers to a tap for dispensing liquids from vessels, particularly vessels of the rigid type or of the so-called "bag-in-box" type. The following description will refer to the application of the inventive tap onto a rigid vessel, commonly used for containing water or similar liquids, but it is obvious that the inventive tap, with few adaptations (removal of air entering mouths and creation of a layout adapted to be placed on a fixing opening for this type of taps), can be used also for "bag-in-box" vessels or other types of vessels.

2) Background Art

In order to dispense water from rigid vessels, very few tap arrangements are known in the art, all characterized by a high number of parts, some of which, due to their nature, are also very costly: the end result is a highly costly tap, that cannot be realized in practice, since it heavily affects the final cost of the liquid-vessel-tap product, cost that is given by stamping and assembling steps.

The known taps are costly because, in applications with rigid vessels, to avoid having to drill the vessel itself so that air enters in it while liquid goes out of it, the tap had to be equipped with at least one air passage able to be actuated (namely able to be opened and closed) together with the liquid dispensing passage. However, all existing taps provide that the two above-mentioned passages are placed one above the other with respect to the liquid dispensing axis: this forces to provide the tap with a control member to be made of two pieces, in order to obtain seal and operation. And the external control piece (namely a sort of dome-shaped resilient push-button), to be realized separately from the control piston, is a very costly piece of resilient plastic material. In addition thereto, there are taps with air passage made of many parts that are opened by rotation (and not by squashing of a resilient membrane), and that have a seal of the cylindrical type—but they have various problems: for example, they have no automatic closure, namely their closure must be performed by the user, they have no warranty seal, etc.

Moreover, the known taps, once being assembled onto a vessel neck, cannot be oriented at will (since once arrived at the end of their thread, they are blocked in place and cannot be moved any more), and therefore require either to make the rear tap area (area with thread+body area+gasket, that allows a relative movement especially adapted to orient the body) of three pieces, in order to obtain seal, operation and orienting, or they require the user to suitably place the vessel to which the tap is connected in such a way as to correctly orient the tap, in order to allow tapping the liquid. Moreover, in case of a body made of a single piece and not three, like the previously described one, a particular thread geometry on the neck is required (it is necessary to adequately compute the thread start both of the vessel neck, and of the tap body in order to orient the tap at the end of its screwing) of the vessel in order to place the part immediately in its correct position.

SUMMARY OF THE INVENTION

Object of the present invention is solving the above prior-art problems, by providing a tap that is composed of a minimum number of pieces and therefore has a reduced cost, realizing in practice the external control member in a single piece with the support body, manufactured in a single material and using traditional and non-complex stamping techniques.

A further object of the present invention is providing a tap as stated above that is equipped with at least one air passage placed laterally with respect to the liquid dispensing passage as regards the liquid dispensing direction: this arrangement allows highly simplifying the final tap geometry and improving its functionality.

A further object of the present invention is providing a tap as stated above that is equipped with a tampering-preventing warranty seal and that, due to the configuration in which it is realized, cannot be removed and installed again on a vessel, thereby providing a double warranty.

A further object of the present invention is providing a tap as stated above that is able to be installed on any type of vessel, independently from torsion or pressure positioning machines with which lines for plugging such vessels are currently equipped: such installation occurs without damaging in any way the internal structure or the external warranty seal of the inventive tap.

A further object of the present invention is providing a tap as stated above that is equipped with such arrangements as to guarantee a resilient return thrust of the external control member in its initial rest position, providing a better seal against liquid exit in case of prolonged dispensing (and therefore thrust on the external control member).

A further object of the present invention is providing a tap as stated above that, once assembled onto a bottle neck, can be oriented at will by the user, that will not be compelled to place the carafe, before the dispensing, depending on the tap position.

A further object of the present invention is providing a tap as stated above that can be adapted, with small dimensional arrangements, to all perform necks of known vessels, exploiting and not modifying the neck geometries. More precisely, the inventive tap will be anchored on the undercut typically used for anchoring the warranty seal of a normal tap for vessels: the vessel neck geometry, as known, is in fact equipped with a thread for screwing and unscrewing the tap and an undercut that allows, when assembling the tap itself, to immovably engage the warranty seal.

The above and other objects and advantages of the invention, as will appear from the following description, are obtained by a dispensing tap as claimed in claim 1. Preferred embodiments and non-trivial variations of the present invention are claimed in the dependent Claims.

BRIEF DESCRIPTION OF THE DRAWINGS

The present invention will be better described by some preferred embodiments thereof, given as a non-limiting example, with reference to the enclosed drawings, in which.

DESCRIPTION OF PREFERRED EMBODIMENTS OF THE INVENTION

Figure 14:
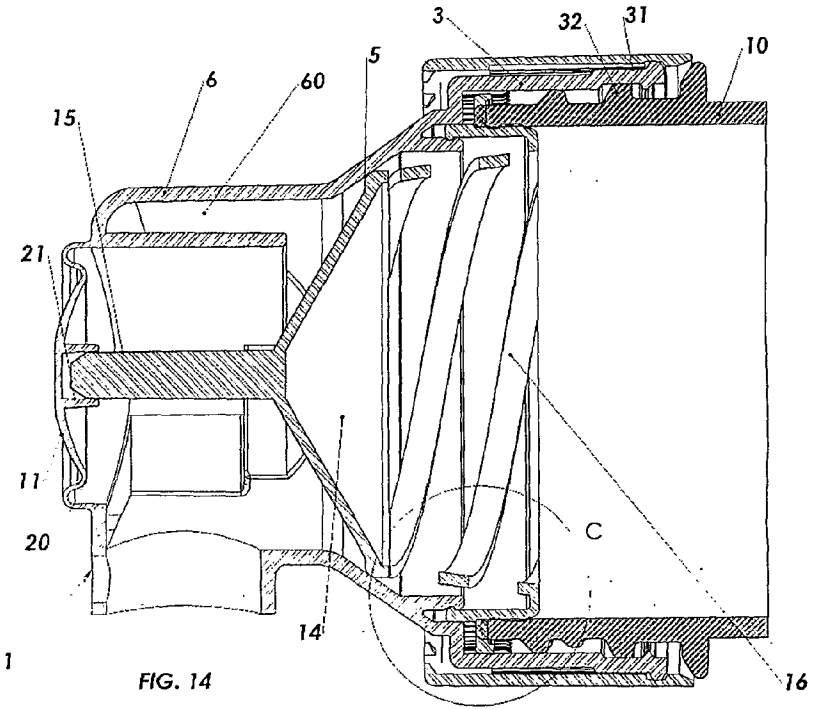
FIG. 14 is a sectional view of the tap in FIG. 1.
Figure 1:
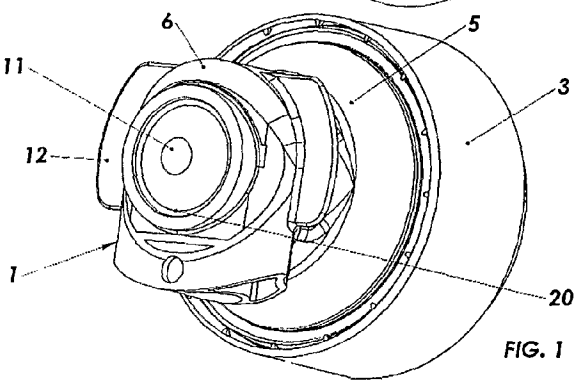
FIG. 1 is a perspective view of an embodiment of the tap according to the present invention.

With reference to the Figures, a preferred and non-limiting embodiment of the dispensing tap 1 of the invention is described. It will be immediately obvious to the skilled people in the art that the described tap can be made in equivalent shapes, sizes and parts, and could be used for various types of vessels, for example the so-called "bag-in-box" vessels or other.

As shown in the Figures, the tap 1 according to the invention is used for dispensing liquids from a vessel (of the rigid or "bag-in-box" type, not shown), and is first of all composed of a body 3 made in a single piece and comprising: a supporting member 5 from which a head 6 projects, which is equipped with at least one mouth 7 for dispensing liquids and at least one mouth 9 for entering air inside the vessel (whose mouth 10 can be seen in some Figures) in parallel to liquid going out of the vessel. The head 6 is further equipped with at least one resilient thrusting member 11 adapted to allow or prevent the dispensing of liquids, and with winged abutting means 12, of a commonly known type.

Figure 13:
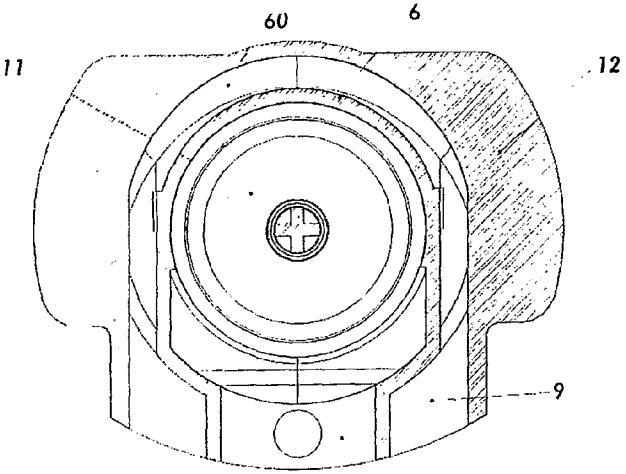
FIG. 13 is a front view of the tap head of FIG. 1.

One of the characteristics of the inventive tap 1 is, as seen, the air entering mouths 9 (that in practice are two) that are laterally placed with respect to the liquid dispensing mouth 7: such arrangement, that can be better seen in FIG. 13, allows realizing a series of passages 9 that are integrated onto the body 3 and are joined in 60 on the upper body part, thereby creating a suitable air chamber separated from the liquid chamber.

The tap 1 further comprises at least one valve member 14 contained inside the body 3 and adapted to engage at one end thereof the outlet mouth 10 of the vessel in order to open/close it; moreover, the valve member 14 is adapted to engage the at least one resilient thrusting member 11 to open and close the liquid dispensing opening.

Figure 8:
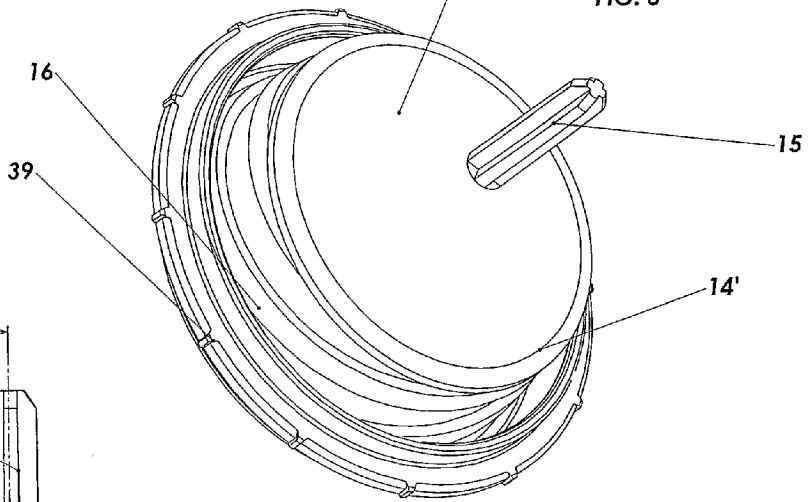
FIG. 8 is a perspective view of an embodiment of the inventive valve member.
Figure 11:
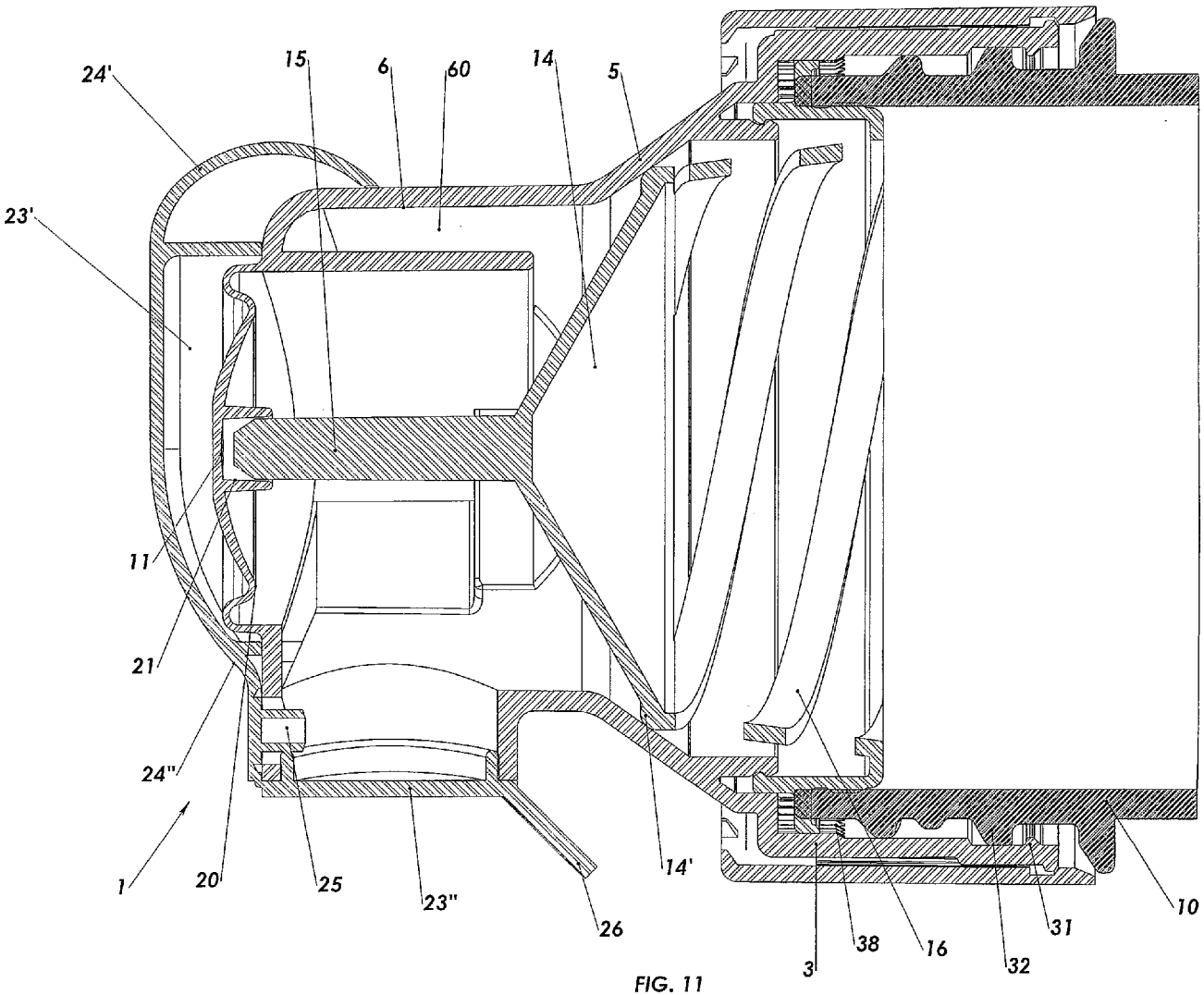
FIG. 11 is a sectional view of the tap in FIG. 1 with a closed warranty seal.

In the embodiment shown, the valve member 14 is composed of a substantially conical body from whose apex an elongated stem 15 departs, which is adapted to engage the resilient thrusting member 11 and made, as can be better seen in FIG. 8, with a cross-shaped geometry, in order to lighten its weight. The valve member 14 body is further equipped, at the opposite end with respect to the one from which the stem 15 departs, with a sealing rim 14', that performs the main seal on the body 3 of the tap 1 by getting in contact with it, as can be better seen in FIGS. 11, 12 and 14. Such sealing rim 14' simultaneously closes the air passage and the liquid passage.

Another characteristic of the inventive tap 1 is that the valve member 14 can be equipped with resilient means 16 adapted to provide the valve member 14 with a thrust for keeping the tap 1 closed when there is no dispensing. In particular, such resilient means 16 are composed of a helical spring, which can be made in a single body with the valve member 14, and is made of the same material as of the valve member 14. It is also possible, and preferable, to make the resilient means 16 of the same material of which body 3 and bell 27 are made, in order to take into account, and simplify, possible problems related to recycling of plastic materials.

The Figures better show the spiral-shape geometry of the spring 16, commonly made of sturdy resilient plastic material. Such spring 16 allows a high ductility as regards the closing force to be applied to the system, since it is enough to slightly change geometry and thickness of the spring 16 to obtain a greater or lower closing force.

In particular, as shown, the resilient thrusting member 11 is composed of a membrane adapted to be thrust towards the body 3 of the tap 1 to allow dispensing liquid and adapted, when the dispensing thrust ceases, to go back into its initial rest position. Such membrane 11 is realized, as seen, integrally with the body 3 of the tap 1, through traditional stamping processes, that allow obtaining the two characteristics of resiliency for the thrusting member 11 and stiffness for the body 3, operating only on piece geometries.

The resilient thrusting member 11 is commonly made with a dome-shaped cross-sectional geometry and is equipped with at least one lip 20 adapted to provide, together with the dome curvature, a thrusting force in order to take back the resilient member 11 in its rest position when there are no thrusts on it. A seat 21 is also present for engaging the stem 15 of the valve member 14.

Figure 16:
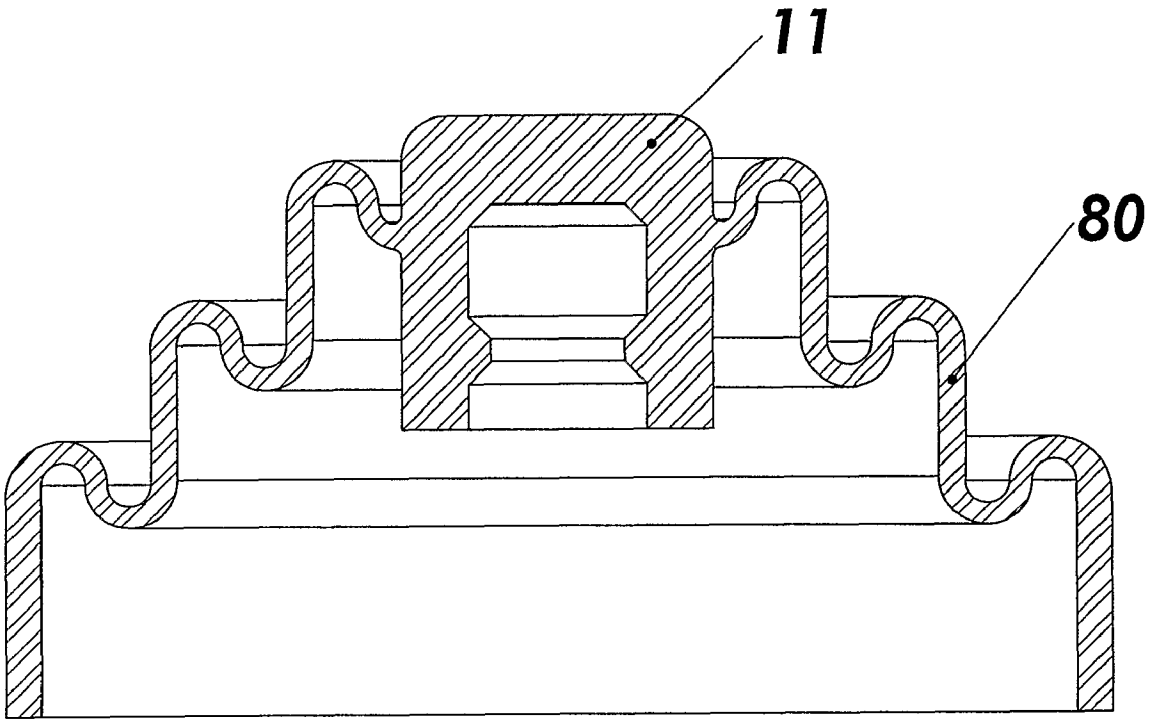
FIGS. 16 to 18 are side sectional views of some realization geometries of the resilient thrust member of the inventive tap.
Figure 17:
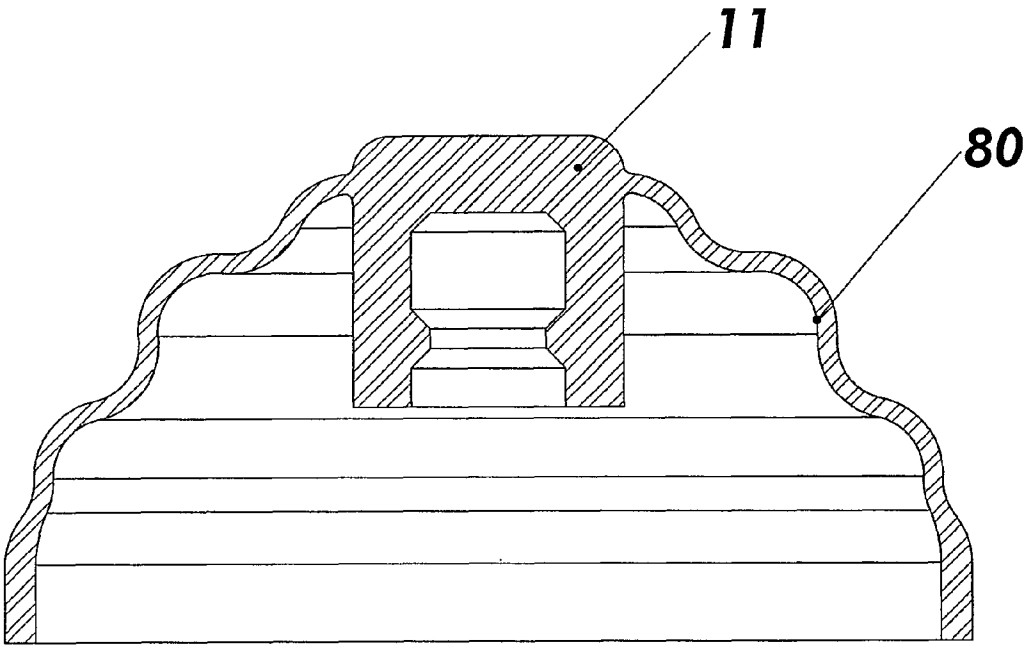
Figure 18:
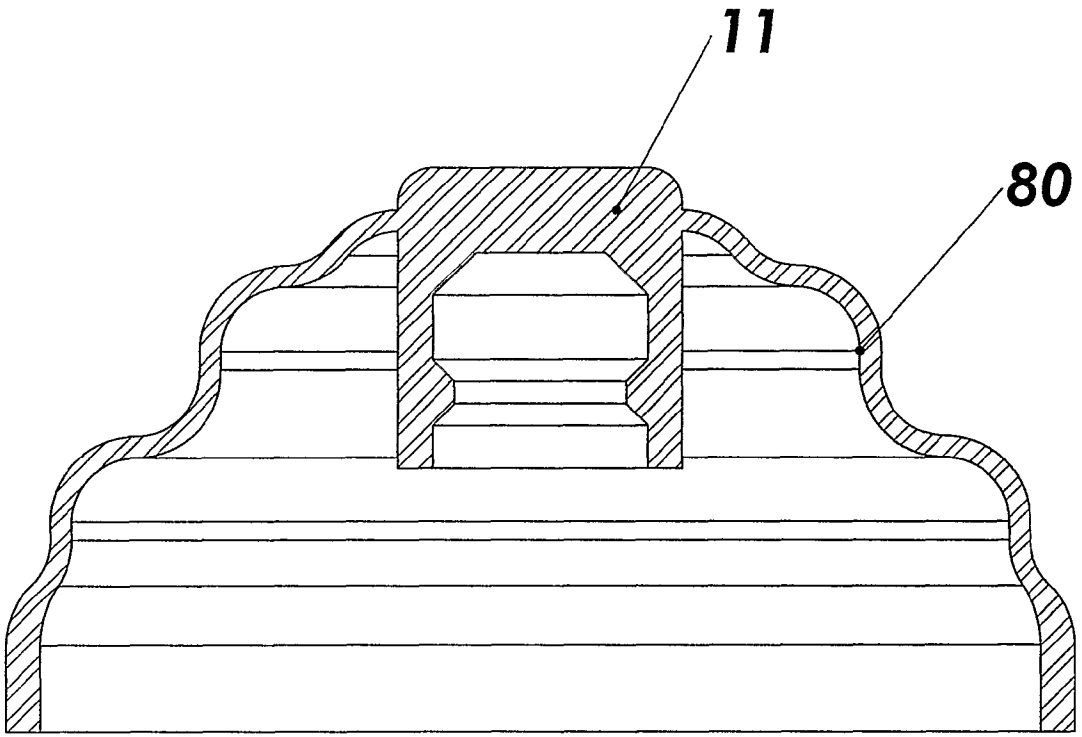

As a variation shown in FIGS. 16 to 18, the resilient thrusting member 11 can be made with a dome-shaped cross-sectional geometry and said dome is composed of a plurality of concentric steps 80 adapted to provide a thrusting force in order to take back the resilient member 11 to its rest position when there are no thrusts over it. In addition to the shown ones, other realization geometries of the resilient member 11 are obviously possible, that can improve its operating efficiency.

The shown resilient member 11 operates when it is subjected to a pressing force (commonly the thrust of a finger of a user's hand) that tends to push it towards the tap 1 interior: such force performs the distortion of the convex part of the resilient member 11 while, simultaneously with such distortion, a flexure of the lip 20 walls will occur outwards, such distortion, when the exerted pressing force ceases, helping to take back the resilient member 11 to its rest position. Two return forces will then occur: one given by the return of the convex part to its position and the other given by the return of the two lip 20 walls.

Another characteristic of the inventive tap 1 is providing a better safety against tampering of liquid inside the vessel: for such purpose, the tap 1 is further equipped with at least one warranty seal 22 adapted to prove the lack of tampering of the tap 1.

According to a first variation, the warranty seal 22 can be composed of at least one first cover 23' for the resilient member 11 and one second cover 23" for the mouth 7, 9 of the head 5. The first cover 23' is hingedly connected (through a first arm 24') and is made in a single piece with, the body 3, and is connected, through a second arm 24", to the second cover 23". Moreover, the second arm 24" is equipped with at least one pin 25, which is adapted to engage the seal 22 or adapted to perform a hot welding of the seal 22 onto the body 3 in order to immovably block the seal 22 onto the body 3. Moreover, the second cover 23" is commonly equipped with a tongue 26 for opening the warranty seal 22 before using the tap 1.

The first cover 23' is equipped, in its part that is externally oriented, with a plane outline that allows providing a plane resting surface, that allows stocking it, for example in supermarkets or in other commercial places. Moreover, during handling, such surface allows stacking one vessel over the other, avoiding squashing the button below.

As a non-limiting alternative, the warranty seal 22 can be composed of a bell 27 placed above the resilient thrusting member 11 and immovably secured to the body 3. The bell 27 is commonly secured to the body 3 through a band 33 adapted to be detached from the bell 27 itself; such band 33 is equipped with a plurality of notches 34 to engage the body 3 and allow the detachment of the band 33 from the bell 27 through a rotating movement when opening. Function of the notches 34 is also preventing the band 33 from rotating and allowing the bell 27 to rotate when assembling the tap 1 onto the vessel through rotating assembling machines, since the notches 34 will get coupled with similar notches 38 that can be found on the body 3. Moreover, the same rotation-preventing coupling allows making the machine, that places the tap onto the vessel, take and discharge its force onto the bell warranty seal, transmitting all the force to the whole tap system without damaging it.

Figure 12:
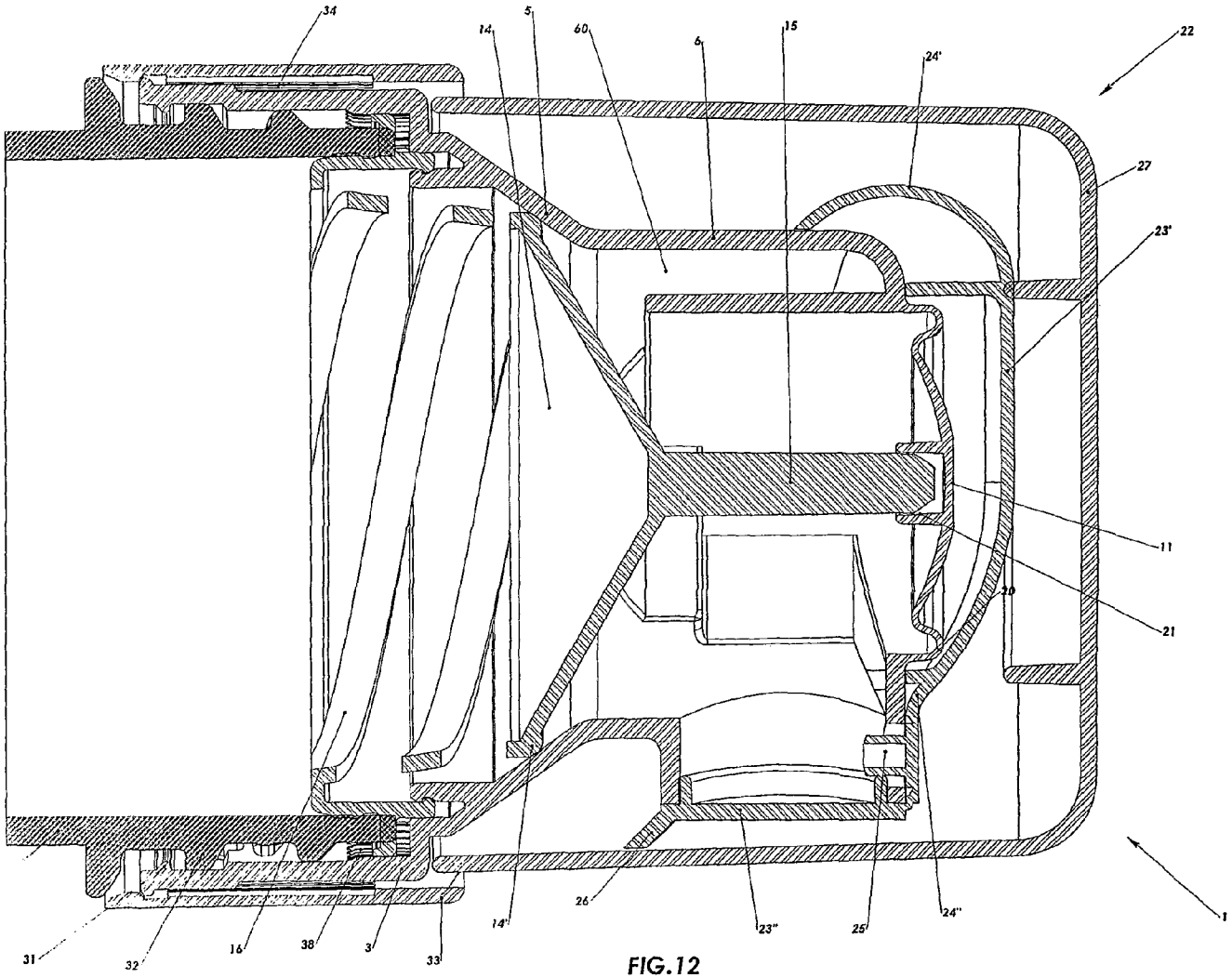
FIG. 12 is a sectional view of the tap in FIG. 1 with the warranty seal of FIG. 4.

As shown in FIG. 12, the bell 27 can also be used in combination with the first variation of the warranty seal 22 (and not only as its alternative), in order to provide a double warranty to the user.

Also the bell 27 is externally equipped with a plane surface that allows resting a plurality of vessels when stacking them, during the stocking and handling phase.

As known, the tap 1 is assembled onto the vessel automatically through various types of machines. The most common types of assembling machines provide assembling operations by rotating of the tap or by snap insertion of the tap itself onto the vessel by pressure, or also through the simultaneous rotation and pressing actions. The inventive tap 1 has been realized with suitable arrangements that allows assembling it on all types of known machines.

In fact, the body 3 is equipped with at least one internal circular projection 31 adapted to engage a corresponding external circular projection 32 (that usually, as stated, is used for anchoring the seal of normal closing taps) placed on the outlet mouth 10 of the vessel, when snappingly assembling the tap 1 onto the vessel.

Figure 7:
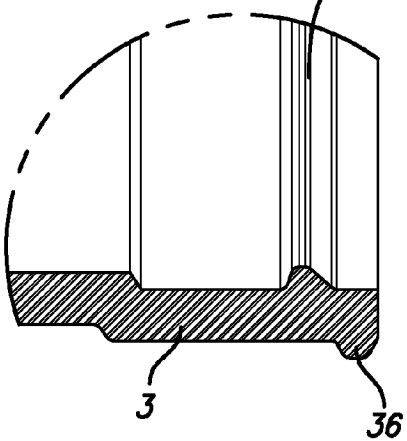
FIG. 7 is a detailed view of a part (zone B) of the body in FIG. 5.
Figure 5:
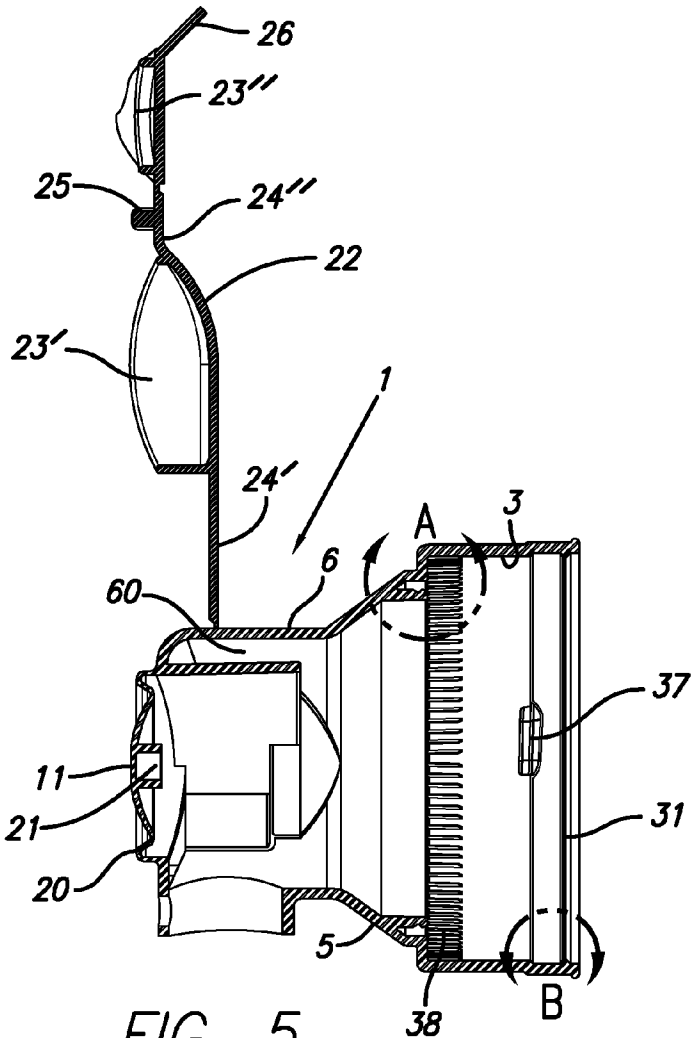
FIG. 5 is a sectional view of the tap body in FIG. 1.

The body 3 is also equipped with an undercut 36 (shown in detail in FIG. 7) that allows anchoring the bell 27 onto the body 3.

Moreover, the tap 1 is equipped with at least one (and preferably three) thread sector 37, which is adapted to allow rotating the body 3 around the outlet mouth 10 of the vessel when rotatingly assembling the tap 1 onto the vessel. Such sectors are suited to the type of thread being present on the vessel neck 10 and, upon screwing them, they follow the thread itself, and therefore allow simulating the same screwing movement performed by a normal plug and the same function of the assembling machine with normal plugs (tap rotation-translation), till it snaps on the above-described undercut (the one that was used before for anchoring the warranty seal of the standard tap). At that time, once the plug is anchored to the vessel neck 10, and therefore once having taken the tap 1 in "draw", it will be characteristically possible to be able to go on rotating the tap 1 in its screwing direction and the thread sectors 37 will again start following the thread till the sector 37 "jumps" the vessel thread and therefore allows repeating the rotation, without anything occurring to the tap 1, since everything is already anchored to the neck 10. In this way, it will be possible to orient the tap 1 in its best position decided by the user.

Moreover, as previously seen, the inventive tap 1 is equipped with a plurality of teeth 38 adapted to prevent a rotation of the valve member 14 that, should it perform a relative rotation with respect to the body 3 of the tap 1, would damage the integrated spring 16, since the first part to be subjected to the braking condition is the part 76 that sealingly goes inside the vessel neck 10 and therefore will be the member that is firstly blocked, or better that will have more friction. This one, however, is also the member connected to the spring 16 that, if it does not rotate integral with the body 3, would damage the spring 16: for this reason, the teeth have been created on the sealing neck 76 geometry, such teeth 38 engaging those teeth created on the body 3 in order to generate a "single body" 1 when rotatingly assembling it.

Moreover, the valve member 14 is equipped with a plurality of notches 39, also adapted to prevent the valve member 14 from rotating when rotatingly assembling the tap 1 onto the vessel.

All these arrangements allows making the rotation-translation force applied to the machine for assembling the tap uniformly propagate to the whole tap system 1 without generating unbalances.

Figure 15:
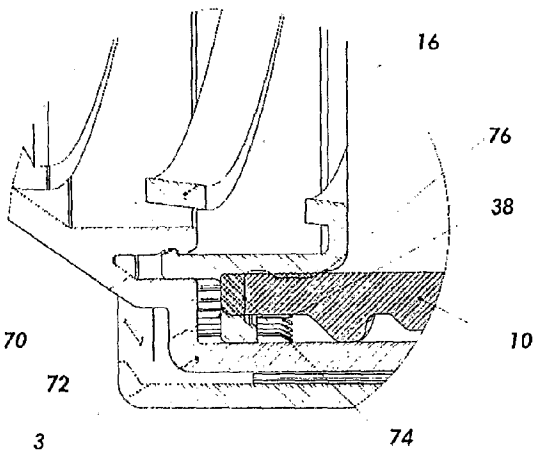
FIG. 15 is a detailed view of a part (zone C) of the body in FIG. 14.
Figure 2:
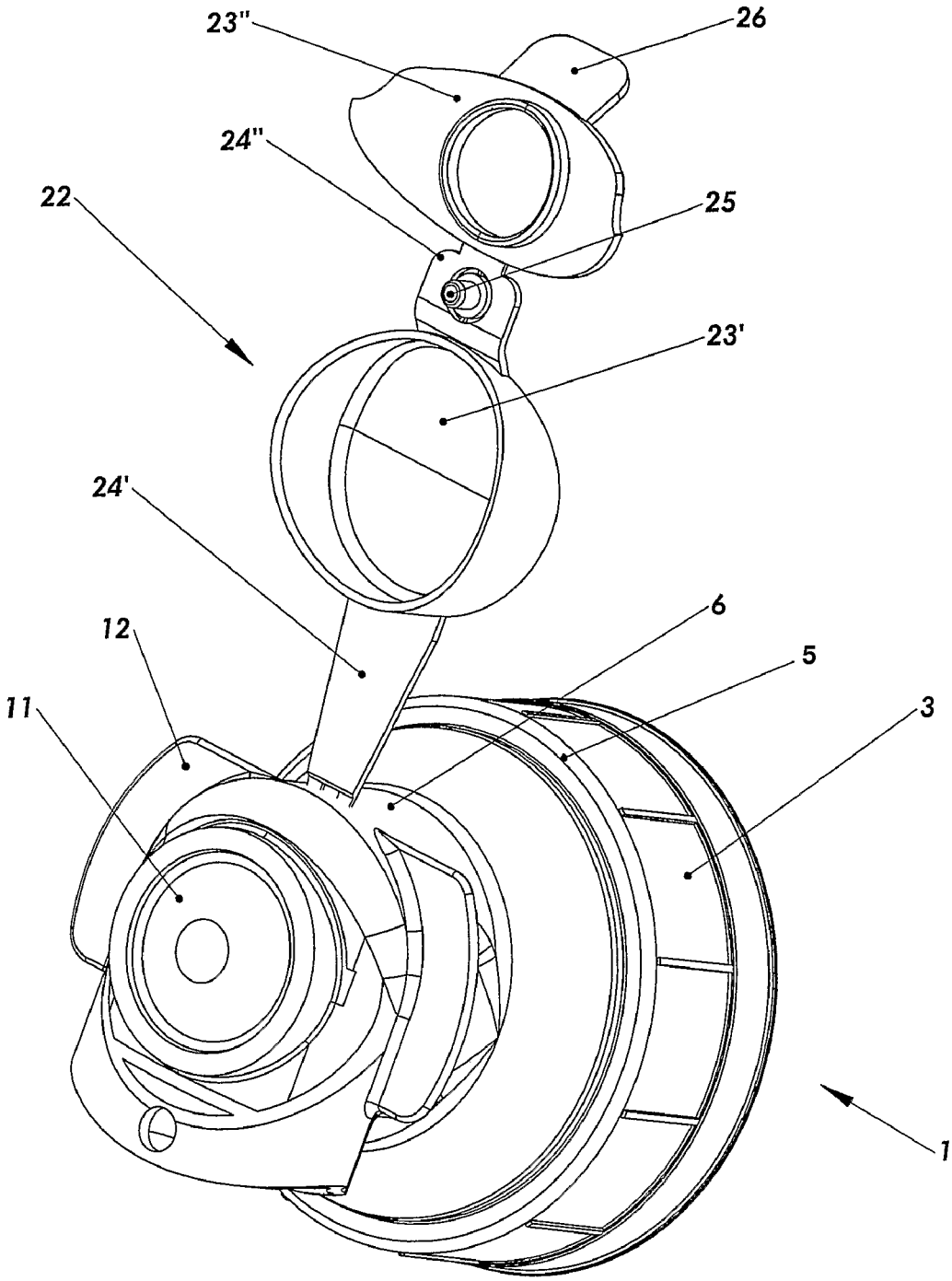
FIG. 2 is another perspective view of the tap in FIG. 1 equipped with a first variation of the warranty seal.
Figure 3:
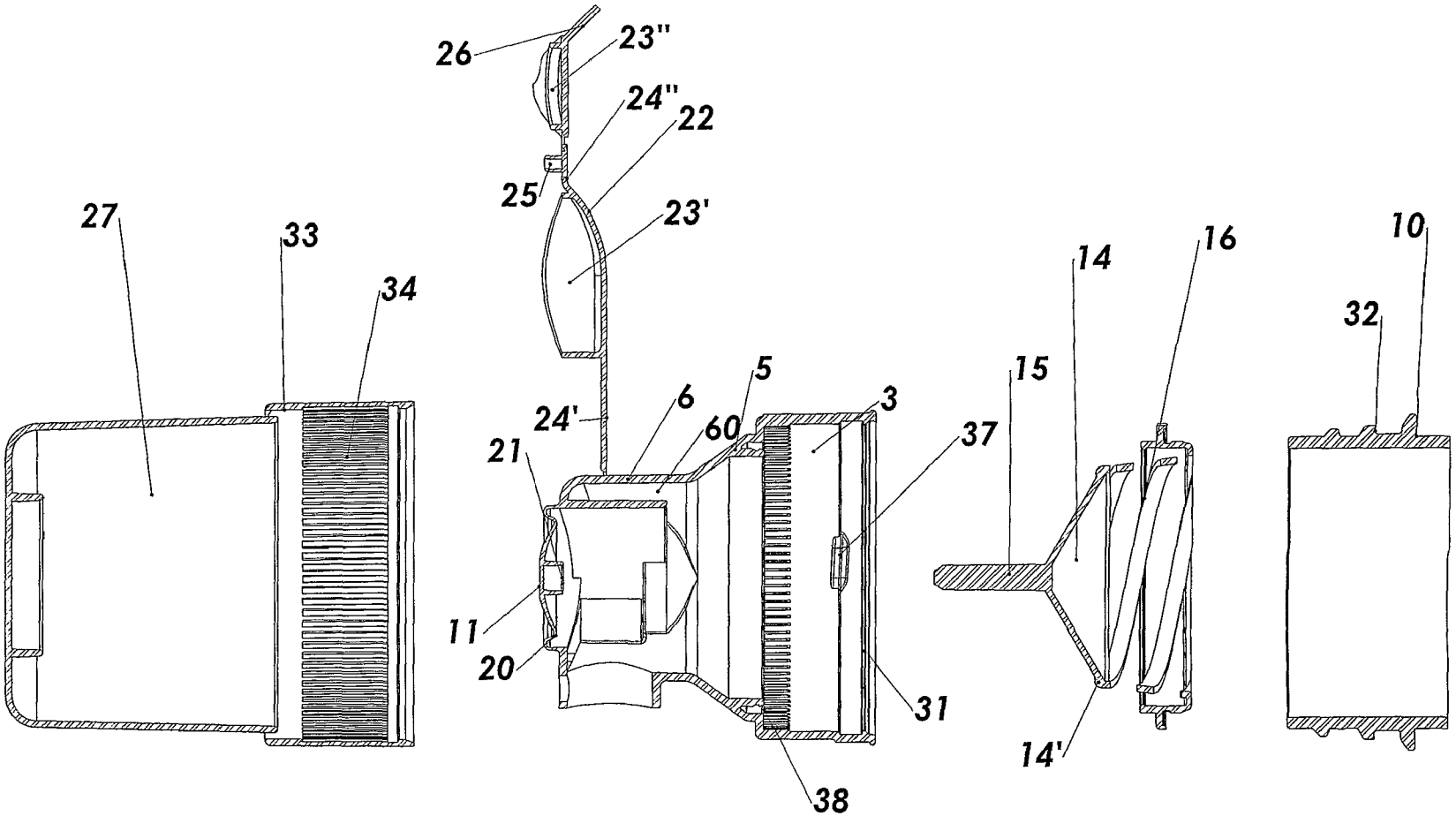
FIG. 3 is an exploded view of the tap in FIG. 1.
Figure 4:
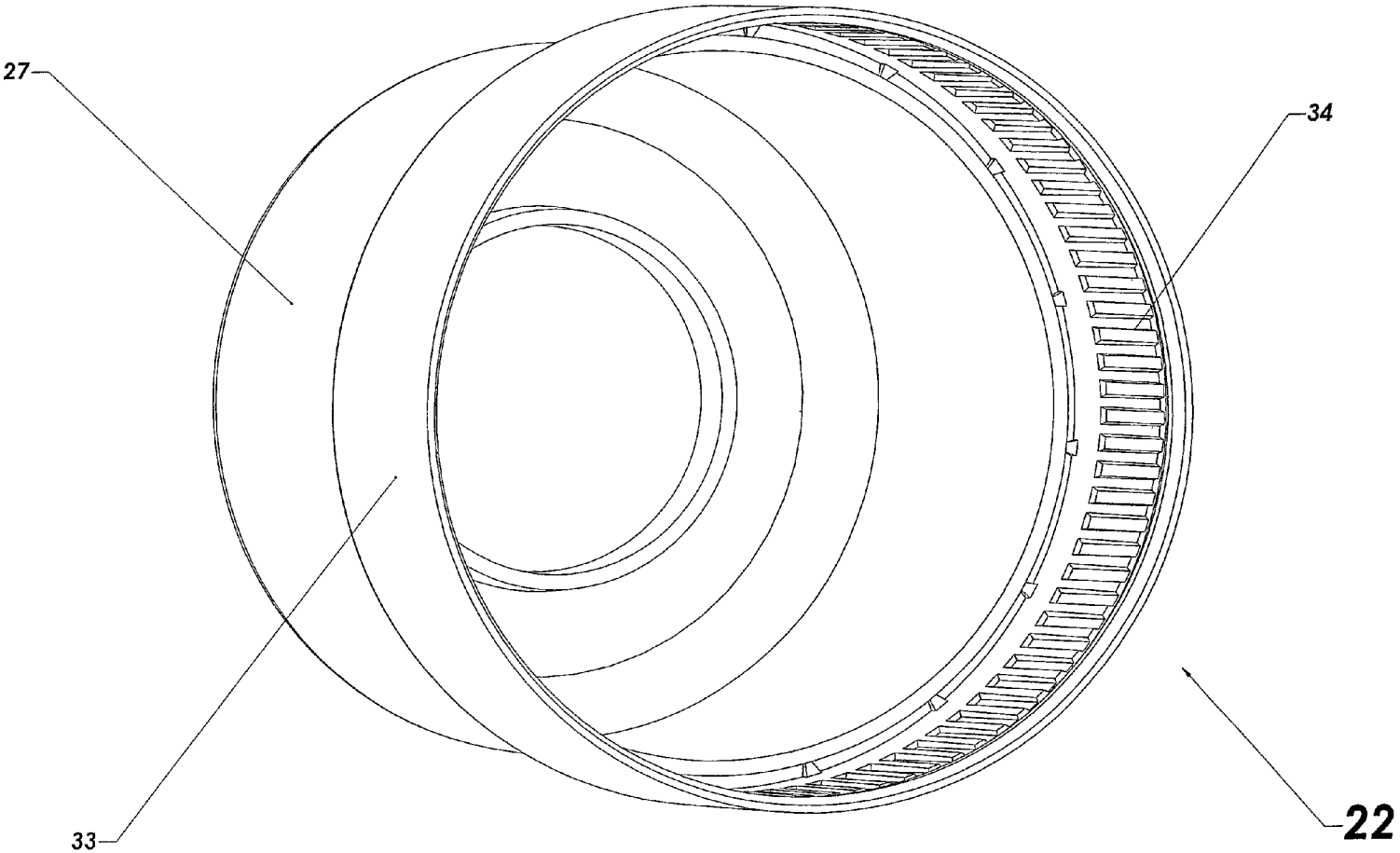
FIG. 4 is a perspective view of a second variation of the warranty seal, of the bell type, equipped with a warranty seal that, after its opening, leaves the seal attached to the body and therefore the vessel, pointing out the fact that it has been opened.
Figure 10:
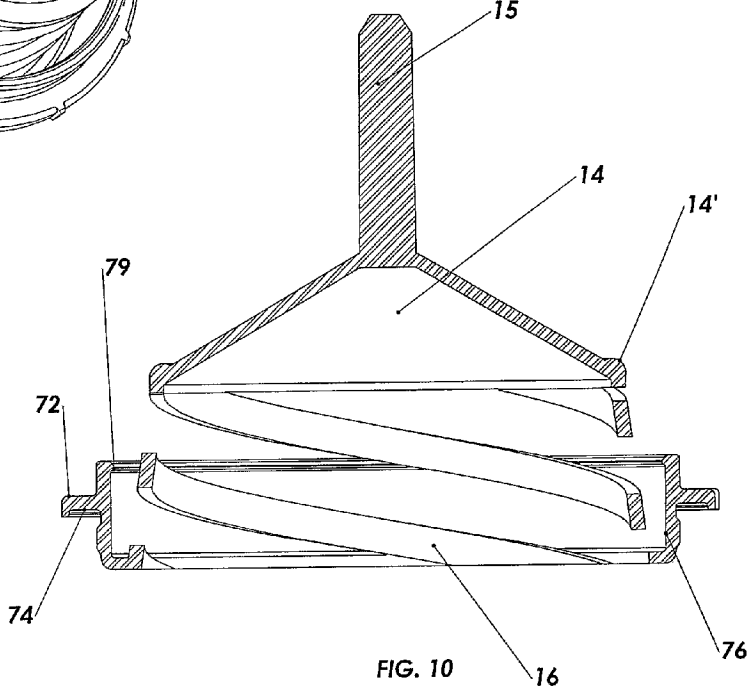
FIG. 10 is a sectional view performed along line X-X in FIG. 9.
Figure 9:
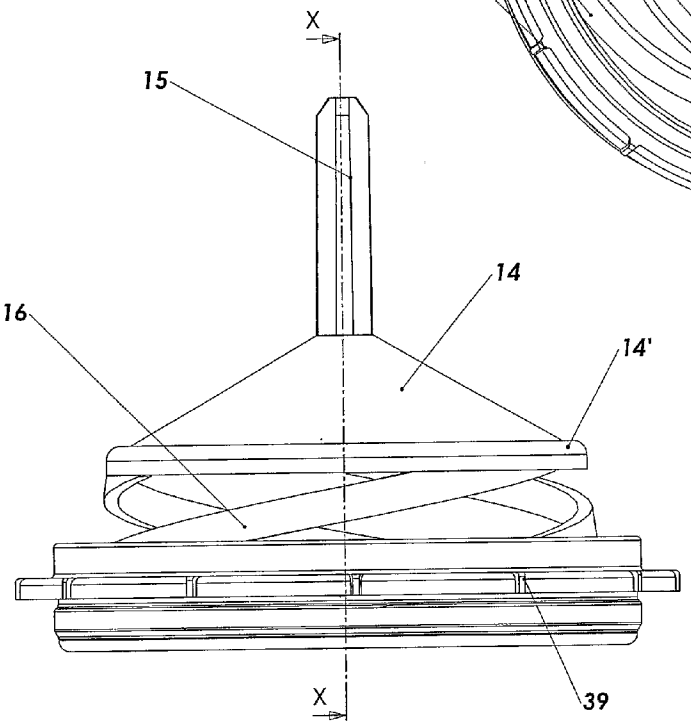
FIG. 9 is a side view of the valve member in FIG. 8.

The inventive tap 1 thereby allows realizing an optimum seal, due to the forces that load all its main components. As can be better seen in FIG. 10 and in detail in FIG. 15, in point 70 the pre-assembling coupling is realized (obviously when the tap 1 will be finally assembled on the vessel neck 10, everything will be squashed to perform the seal) between body 3 and valve member 14 with integrated spring 16, while reference 72 designates the sealing area between body 3 and valve member 14, reference 74 designates the sealing area between vessel mouth 10 and tap 1, and reference 76 designates the sealing cone being present on the mouth 10 integrated with the valve member 14.

Figure 6:
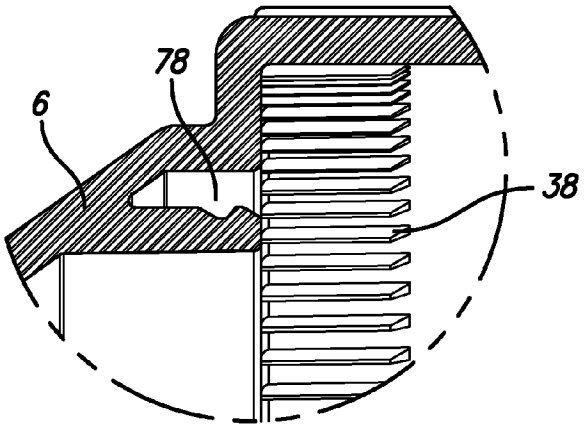
FIG. 6 is a detailed view of a part (zone A) of the body in FIG. 5.

Still in FIG. 6, reference 78 designates the undercut that keeps in a pre-assembling position the valve member 14 onto the body 3, due to the small pre-assembling sealing tooth 79, as further characteristic embodiment of the tap 1 of the invention.

In order to better realize all above-mentioned inventive characteristics, the inventive tap 1 is preferably made of plastic material. Moreover, for its arrangement, in addition to its traditional application on rigid vessels, particularly adapted to contain water, the inventive tap 1 can find immediate application also onto a vessel of the "bag-in-box" type, in which the tap 1, according to the applications, is placed in a vertical or horizontal position with respect to the main vessel axis. The engineering arrangements adapted to realize such horizontal or vertical placement on this type of vessel will be immediately obvious for the skilled people in the art after having read the present document.

In the inventive tap, the tap closure can be performed only with the return push-button force that will keep the plunger member squashed (in this case, some undercuts will have to be obtained, on part of the plunger and on the "lower" part of the resilient button, such undercuts keeping the two members connected and guaranteeing that the plunger member itself is kept tensioned on the body) or through the joint action of a spring integrated onto the plunger and the valve (always with the undercuts obtained in the push-button area and on the plunger nose), or still through the integrated spring member only that, by abutting onto the vessel neck, will be tensioned and will bias onto the body (in this case, doing without the undercuts).

The invention claimed is:

1. A tap for dispensing liquids from a vessel, comprising:

a) a body made in a single piece comprising a supporting member from which a head projects, said head being equipped with at least one first mouth for dispensing liquids and at least one second mouth for entering air inside said vessel in parallel to liquid going out of said vessel; at least one resilient thrusting member adapted to allow or prevent liquids from being dispensed; and winged abutting means;

b) at least one valve member contained inside said body and adapted to engage at one end an outlet mouth of said vessel in order to open and close the outlet mouth, said valve member being adapted to engage said at least one resilient thrusting member to open and close an opening for dispensing liquids; and c) at least one warranty seal adapted to prove the lack of tampering of the tap;

wherein said warranty seal comprises at least one first cover for said resilient member and one second cover for said first or second mouth of said head, said first cover being hingedly connected, through a first arm and being made in a single piece with said body, said first cover being connected through a second arm to said second cover.

2. The tap according to claim 1, wherein said valve member is equipped with resilient means adapted to provide said valve member with a thrust for keeping said tap closed when there is no dispensing.

3. The tap according to claim 2, wherein said resilient means comprise a helical spring.

4. The tap according to claim 3, wherein said helical spring is made in a single body with said valve member and is made of the same material as of the valve member.

5. The tap according to claim 1, wherein said at least one second mouth for entering air is arranged, with respect to a direction along which liquid goes out, laterally with respect to said at least one first liquid dispensing mouth.

6. The tap according to claim 1, wherein said at least one second mouth for entering air are two mouths, and are arranged laterally on two opposite sides with respect to said first liquid dispensing mouth.

7. The tap according to claim 1, wherein said at least one resilient thrusting member comprises a membrane adapted to be thrust towards said body to allow dispensing liquid and adapted, when the dispensing thrust ceases, to go back into its initial rest position.

8. The tap according to claim 1, wherein said resilient thrusting member is made with a dome-shaped cross-sectional geometry and is equipped with at least one lip adapted to provide, together with the dome curvature, a thrusting force in order to take back said resilient member in a rest position.

9. The tap according to claim 1, wherein said resilient thrusting member is made with a dome-shaped cross-sectional geometry, and said dome comprises a plurality of concentric steps adapted to provide a thrusting force in order to return said resilient member to a rest position.

10. The tap according to claim 1, wherein said second arm is equipped with at least one pin, said pin being adapted to engage said seal or adapted to perform a hot welding of said seal onto said body in order to immovably block said seal onto said body.

11. The tap according to claim 1, wherein said second cover is equipped with a tongue for opening said warranty seal before using said tap.

12. The tap according to claim 1, wherein said first cover is externally equipped with a plane surface that allows resting a stack of a plurality of vessels, when stocking and handling them.

13. The tap according to claim 1, wherein said warranty seal is made like a bell placed above said resilient thrusting member and immovably secured to said body, said bell being secured to said body through a detachable band equipped with a plurality of notches to engage said body, said notches being adapted to prevent said bell from rotating with respect to said band when rotatingly assembling the tap onto the vessel.

14. The tap according to claim 13, wherein said body is further equipped with an undercut adapted to allow anchoring said bell onto said body.

15. The tap according to claim 13, wherein said bell is externally equipped with a planar surface that allows resting a stack of a plurality of vessels, when stocking and handling them.

16. The tap according to claim 1, wherein said warranty seal comprises a combination of said first cover, second cover and bell.

17. The tap according to claim 1, wherein said body is equipped with at least one internal circular projection adapted to engage a corresponding external circular projection placed on the outlet mouth of said vessel, when snappingly assembling said tap onto said vessel.

18. The tap according to claim 1, wherein said body is equipped with at least one thread sector adapted to allow rotating said body around the outlet mouth of said vessel when rotatingly assembling said tap onto said vessel.

19. The tap according to claim 18, wherein said thread sectors are three.

20. The tap according to claim 1, wherein said body is equipped with a plurality of teeth adapted to prevent a rotation of said body when rotatingly assembling said tap onto said vessel.

21. The tap according to claim 1, wherein said valve member is equipped with a plurality of notches adapted to prevent said valve member from rotating when rotatingly assembling said tap onto said vessel.

22. The tap according to claim 1, wherein said tap is made of plastic material.

23. The tap according to claim 1, wherein said vessel is of the rigid type, adapted to contain water.

24. The tap according to claim 1, wherein said vessel is of the "bag-in-box" type, and said tap is placed in a vertical position with respect to a main axis of said vessel.

25. The tap according to claim 1, wherein said vessel is of the "bag-in-box" type, and said tap is placed in a horizontal position with respect to a main axis of said vessel.

26. A tap for dispensing liquids from a vessel, comprising:

a) a body made in a single piece comprising a supporting member from which a head projects, said head being equipped with at least one first mouth for dispensing liquids and at least one second mouth for entering air inside said vessel in parallel to liquid going out of said vessel; at least one resilient thrusting member adapted to allow or prevent liquids from being dispensed; and winged abutting means; and b) at least one valve member contained inside said body and adapted to engage at one end an outlet mouth of said vessel in order to open and close the outlet mouth, said valve member being adapted to engage said at least one resilient thrusting member to open and close an opening for dispensing liquids;

wherein said valve member is equipped with a plurality of notches adapted to prevent said valve member from rotating when rotatingly assembling said tap onto said vessel.

27. The tap according to claim 26, wherein said valve member is equipped with resilient means adapted to provide said valve member with a thrust for keeping said tap closed when there is no dispensing.

28. The tap according to claim 27, wherein said resilient means comprise a helical spring.

29. The tap according to claim 28, wherein said helical spring is made in a single body with said valve member and is made of the same material as of the valve member.

30. The tap according to claim 26, wherein said at least one second mouth for entering air is arranged, with respect to a direction along which liquid goes out, laterally with respect to said at least one first liquid dispensing mouth.

31. The tap according to claim 26, wherein said at least one second mouth for entering air are two mouths, and are arranged laterally on two opposite sides with respect to said first liquid dispensing mouth.

32. The tap according to claim 26, wherein said at least one resilient thrusting member comprises a membrane adapted to be thrust towards said body to allow dispensing liquid and adapted, when the dispensing thrust ceases, to go back into its initial rest position.

33. The tap according to claim 26, wherein said resilient thrusting member is made with a dome-shaped cross-sectional geometry and is equipped with at least one lip adapted to provide, together with the dome curvature, a thrusting force in order to take back said resilient member in a rest position.

34. The tap according to claim 26, wherein said resilient thrusting member is made with a dome-shaped cross-sectional geometry, and said dome comprises a plurality of concentric steps adapted to provide a thrusting force in order to return said resilient member to a rest position.

35. The tap according to claim 26, further comprising at least one warranty seal adapted to prove the lack of tampering of the tap.

36. The tap according to claim 35, wherein said warranty seal comprises at least one first cover for said resilient member and one second cover for said first or second mouth of said head, said first cover being hingedly connected, through a first arm and being made in a single piece with said body, said first cover being connected through a second arm to said second cover.

37. The tap according to claim 36, wherein said second arm is equipped with at least one pin, said pin being adapted to engage said seal or adapted to perform a hot welding of said seal onto said body in order to immovably block said seal onto said body.

38. The tap according to claim 36, wherein said second cover is equipped with a tongue for opening said warranty seal before using said tap.

39. The tap according to claim 36, wherein said first cover is externally equipped with a plane surface that allows resting a stack of a plurality of vessels, when stocking and handling them.

40. The tap according to claim 35, wherein said warranty seal is made like a bell placed above said resilient thrusting member and immovably secured to said body, said bell being secured to said body through a detachable band equipped with a plurality of notches to engage said body, said notches being adapted to prevent said bell from rotating with respect to said band when rotatingly assembling the tap onto the vessel.

41. The tap according to claim 40, wherein said body is further equipped with an undercut adapted to allow anchoring said bell onto said body.

42. The tap according to claim 40, wherein said bell is externally equipped with a planar surface that allows resting a stack of a plurality of vessels, when stocking and handling them.

43. The tap according to claim 36, wherein said warranty seal comprises a combination of said first cover, second cover and bell.

44. The tap according to claim 26, wherein said body is equipped with at least one internal circular projection adapted to engage a corresponding external circular projection placed on the outlet mouth of said vessel, when snappingly assembling said tap onto said vessel.

45. The tap according to claim 26, wherein said body is equipped with at least one thread sector adapted to allow rotating said body around the outlet mouth of said vessel when rotatingly assembling said tap onto said vessel.

46. The tap according to claim 45, wherein said thread sectors are three.

47. The tap according to claim 26, wherein said body is equipped with a plurality of teeth adapted to prevent a rotation of said body when rotatingly assembling said tap onto said vessel.

48. The tap according to claim 26, wherein said tap is made of plastic material.

49. The tap according to claim 26, wherein said vessel is of the rigid type, adapted to contain water.

50. The tap according to claim 26, wherein said vessel is of the "bag-in-box" type, and said tap is placed in a vertical position with respect to a main axis of said vessel.

51. The tap according to claim 26, wherein said vessel is of the "bag-in-box" type, and said tap is placed in a horizontal position with respect to a main axis of said vessel.

* * * * *